US005193490A

United States Patent [19]

Peruski

[11] Patent Number: 5,193,490

[45] Date of Patent: Mar. 16, 1993

[54] CYCLONIC MIXING AND COMBUSTION CHAMBER FOR CIRCULATING FLUIDIZED BED BOILERS

[75] Inventor: Mark E. Peruski, Canton, Ohio

[73] Assignee: The Babcock & Wilcox Company, New Orleans, La.

[21] Appl. No.: 753,509

[22] Filed: Sep. 3, 1991

[51] Int. Cl.[5] ..... F22B 1/00

[52] U.S. Cl. ..... 122/4 D; 110/245; 110/265; 110/347

[58] Field of Search ..... 110/245, 263-265; 122/4 D

[56] References Cited

U.S. PATENT DOCUMENTS

| | | | |
|---|---|---|---|
| 4,446,629 | 5/1984 | Stewart et al. | 34/57 A |
| 4,528,945 | 7/1985 | Virr et al. | 122/4 D |
| 4,535,706 | 8/1985 | Klaschka | 110/245 |
| 4,539,939 | 9/1985 | Johnson | 122/4 D |
| 4,542,716 | 9/1985 | Dreuilhe et al. | 122/4 D |
| 4,552,203 | 11/1985 | Chrysostome et al. | 122/4 D |
| 4,594,967 | 6/1986 | Wolowodiuk | 122/4 D |
| 4,724,780 | 2/1988 | Hoffert et al. | 110/265 |
| 4,733,619 | 3/1988 | Maeda et al. | 110/245 |
| 4,785,746 | 11/1988 | Roy et al. | 110/265 |
| 4,981,111 | 1/1991 | Bennett et al. | 110/347 |
| 4,993,332 | 2/1991 | Boross et al. | 110/245 |

*Primary Examiner*—Henry C. Yuen

*Attorney, Agent, or Firm*—Vytas R. Matas; Robert J. Edwards; Eric Marich

[57] ABSTRACT

An apparatus for supplying fluidized bed material to a circulating fluidized bed boiler having a primary zone with a fuel feed point and a furnace zone above the primary zone, a mixing chamber for receiving solid fuel and a portion of the total combustion air needed in the boiler. The combustion air and circulating fluidized bed solids are supplied tangentially into the chamber which is advantageously in the form of a horizontally extending cylinder. The combustion air and solids are intimately mixed with each other before they are discharged into the primary zone of the boiler. The primary zone of the boiler is shaped with an upwardly increasing cross sectional area so that the already mixed combustion air and solids diffuse evenly through the fluidized bed boiler.

8 Claims, 6 Drawing Sheets

CYCLONIC MIXING AND COMBUSTION CHAMBER FOR CIRCULATING FLUIDIZED BED BOILERS

FIELD AND BACKGROUND OF THE INVENTION

The present invention relates in general to fluidized bed boilers and, in particular, to a new and useful apparatus for feeding solids to the fluidized bed of a fluidized bed boiler.

The combustion zone of a circulating fluidized bed (CFB) boiler 10, as shown in FIG. 1, is divided into two parts; the primary zone 12 and the furnace or secondary zone 18. The primary zone, located below the furnace, is the area where the circulating fluidized bed solids are re-injected back into the combustion zone by a particle separator 14 and return line 16. A non-mechanical seal or valve 32 is provided in return line 16. The primary zone is also where fuel and sorbent for sulfur retention (if required) is introduced. The primary zone acts as a distribution zone for solids (CFB solids, fuel and sorbent) so they are evenly distributed across the primary zone and furnace and as a preliminary combustion zone. Fifty to 100% of the total combustion air is fed into the bottom of the primary zone at a windbox 20. The remaining combustion air is fed in through wall ports 22. These wall ports define the separation between the primary zone 12 and the furnace 18. Combustion is completed in the furnace. The primary zone has a refractory lining 24 as it is exposed to a reducing atmosphere. The furnace is refractory lined only in high erosion areas. The boiler also includes a convection pass 30 for the hot exhaust gases.

A major problem area for CFB boilers is in firing high volatile or highly reactive fuels such as wood. The usual means of feeding fuel into the primary zone of a CFB boiler is with a screw conveyor 26 which pushes the fuel in through a wall port called the fuel feed point 28. A highly reactive fuel will devolitize in the area immediately around the fuel feed point. This results in a plume of combustible gases immediately over the fuel feed point. These concentrated combustible gases cannot readily mix with the combustion air because the air is evenly distributed across the cross section of the primary zone and the furnace. The result is a temperature gradient across the unit due to the combustion being concentrated at the combustible gases plume above the fuel feed point. This high temperature zone encourages NOx formation. Also, the poor mixing of the combustible gas with the combustion air can lead to low combustion efficiency, high CO emissions and combustion occurring in the solids separator and in the convection pass.

What is needed is a close, intimate mixing of fuel, air and circulating bed solids in a way such that they are evenly distributed in the primary zone and that combustible gases, air and circulating bed solids are intimately mixed and evenly distributed in the furnace.

U.S. Pat. No. 4,552,203 to Chrysostome, et al discloses a fluidized bed reactor having a particle return and supply mechanism which includes a feed screw and conduit that receives both cold and hot portions of the particles being returned to the fluidized bed. Gas is injected along the length of the return conduit for suspending and conveying the solid particles.

A fluidized bed having an inlet zone which is positioned laterally of the combustion zone, is disclosed in U.S. Pat. No. 4,585,706 to Klaschka.

A boiler with a fluidized bed which is divided into a deep part with walls inclined toward a lower outlet, and a shallow part above the deep part, is disclosed in U.S. Pat. No. 4,528,945 to Virr, et al. Fuel is supplied by a feed screw near the top of the upper shallow part of the bed.

Other U.S. patents showing fluidized beds where the fuel is supplied at a relatively high location in the bed area include U.S. Pat. Nos. 4,446,629 to Stewart, et al; 4,539,939 to Johnson; and 4,542,716 to Dreuilhe, et al.

U.S. Pat. No. 4,594,967 to Wolowodiuk discloses a fluidized bed which is divided into separate bed portions.

SUMMARY OF THE INVENTION

The present invention seeks to avoid the major problem area for CFB boilers, wherein volatile or highly reactive components of the fuels introduced at the fuel feed point do not mix sufficiently with the combustion air in the primary zone of the boiler.

Accordingly one aspect of the present invention is to provide an apparatus for supplying fluidized bed material to a circulating fluidized bed boiler having a primary zone with a fuel feed point for the fluidized bed material, and a furnace zone above the primary zone, the apparatus comprising: means defining a mixing chamber having a first inlet for receiving solid fuel, a second inlet for receiving fluidized bed solids, and an outlet connected to the fuel feed point; fuel feed means connected to the first mixing chamber inlet for feeding solid fuel to the mixing chamber; first combustion air supply means connected to the primary zone of the boiler for supplying a part of the total combustion air needed for combustion to the primary zone; and second combustion air supply means connected to the mixing chamber for supplying another portion of the total amount of combustion air needed, directly to the mixing chamber for facilitating mixing between the combustion air, the fluidized bed solids and the solid fuel, in the mixing chamber, which mixture is supplied to the mixing chamber outlet to the primary zone of the boiler, and wherein said first inlet and said second combustion air supply means are connected for tangential feed into said mixing chamber at a location near said first inlet and spread away from the fuel feed point.

The mixing chamber is advantageously a cyclonic mixing and combustion chamber which is cylindrical in shape, extends horizontally and has a refractory lining. No heat absorbing surfaces are incorporated into the chamber unless required for structural strength and support.

Both the combustion air of the second combustion air supply means and the fluidized bed solids are supplied tangentially into the cylindrical mixing chamber to help facilitate mixing of the different components in the chamber. The present invention is particularly suited to fuels which have high volatile contents or which themselves are highly reactive, such as wood particles or chips. The fluidized bed solids which are supplied to the mixing chamber separately from the fuel, include conventional CFB solids such as limestone or absorbent for sulfur retention.

Preferably, from approximately 25 to 45% of the total combustion air is supplied through the second combustion air supply means into the mixing chamber. A total of from approximately 60 to 80% of the total combustion air is supplied through the first and second combustion air supply means jointly. The remainder of the combustion air is supplied through combustion air wall ports which are positioned between the primary zone and the secondary zone in the combustion zone of the boiler.

In accordance with another important feature of the present invention, the primary zone is configured to have an upwardly increasing cross sectional area. This can be achieved by utilizing one or more inclined walls for the primary zone, so that the primary zone is in the form of a wedge or hopper. These walls diverge in an upward direction.

The fuel feed point is also advantageously located near the bottom of the primary zone. This combination of features further enhances the dispersion effect of the well mixed combustion air, fluidized bed solids and solid fuel, into the resident fluidized bed and combustion air mass in the primary zone. As they rise in the primary zone, the CFB solids, combustible gases and combustion air will diffuse at a same rate which will match the expansion area of the primary zone. Since the CFB solids, combustible gases and combustion air are well mixed at the bottom of the primary zone, they will remain well mixed as they diffuse. In accordance with the present invention, the primary zone is refractory lined since it will run substoichiometrically. The primary zone ends at the combustion air wall ports.

Since the height of the primary zone may become extremely tall if a large slope is used for its walls, the height of the primary zone can be reduced by placing the combustion air wall ports on the sloped walls so that the furnace zone starts in the wedge shaped lower portion of the boiler.

Advantages of the present invention include the fact that a larger number of combustion air stages is provided. As opposed to the conventional use of two stages for CFB boilers, one at the bottom of the primary zone and the other at the wall ports between the primary zone and the furnace zone, the CFB boiler with the cyclonic mixing and combustion chamber (CMCC) system of the present invention uses these combustion air feed points plus the combustion air feed in the CMCC. With more stages of combustion air feed there is better mixing of fuel and air, better burn-out, lower NOx and lower CO emissions, and a more even temperature profile in the boiler.

The CMCC system provides better mixing of fuel, combustion air and CFB solids and insures that the resultant combustion gases are well mixed with the CFB solids when they enter the primary zone where they mix with additional combustion air. The result is uniform combustion without any pockets of intense combustion. The good mixing achieved in accordance with the present invention also insures an even distribution of CFB solids and combustible gas in the furnace since they will diffuse simultaneously in the wedge shaped primary zone.

The present invention also provides a simplified fuel feed system. In order to achieve the same fuel and air mixing in the primary zone offered by the CMCC system of the present invention, a conventional CFB boiler would have to utilize a complex, multipoint, underbed fuel feed system. The CMCC system offers excellent fuel and air mixing with a few simple parts. No auxiliary burner is required. For standard CFB boilers, a duct burner or auxiliary burner is required for warming the boiler and the circulating bed material. With a CMCC system oil or gas may be fired in the CMCC for warming the boiler and the circulating bed. The oil or gas can be fed into the combustion air duct of the CMCC in a manner similar to that used to fire oil in a cyclone burner.

Accordingly, another aspect of the present invention is to provide an apparatus for supplying fluidized bed material to a CFB boiler which is simple in design, rugged in construction and economical to manufacture.

The various features of novelty which characterize the invention are pointed out with particularity in the claims annexed to and forming a part of this disclosure. For a better understanding of the invention, its operating advantages and specific results attained by its uses, reference is made to the accompanying drawings and descriptive matter in which the preferred embodiments of the invention are illustrated.

DESCRIPTION OF THE PREFERRED EMBODIMENTS

Figure 1:
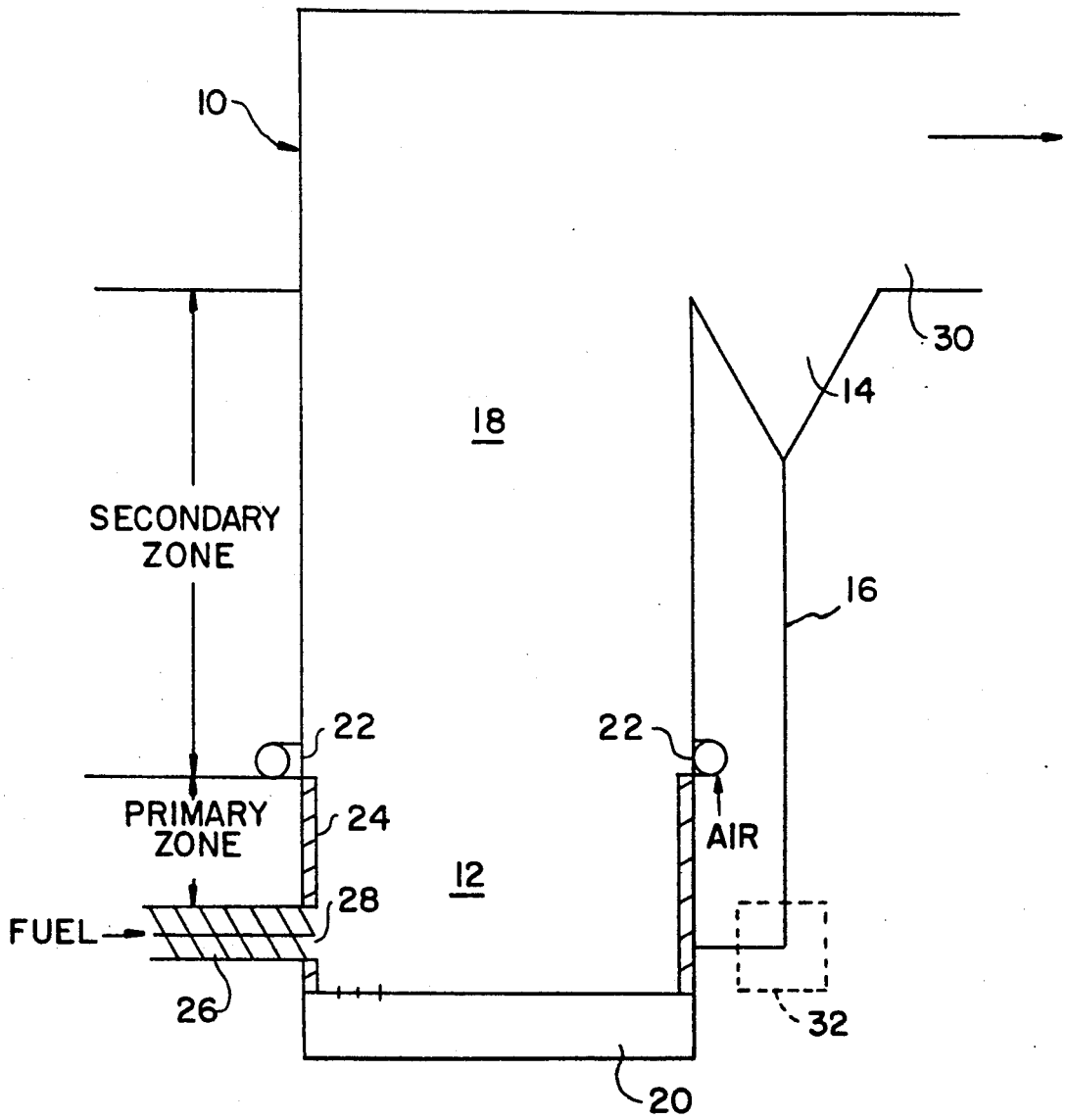
FIG. 1 is a schematic vertical sectional view of a circulating fluidized bed boiler of standard design.
Figure 2A:
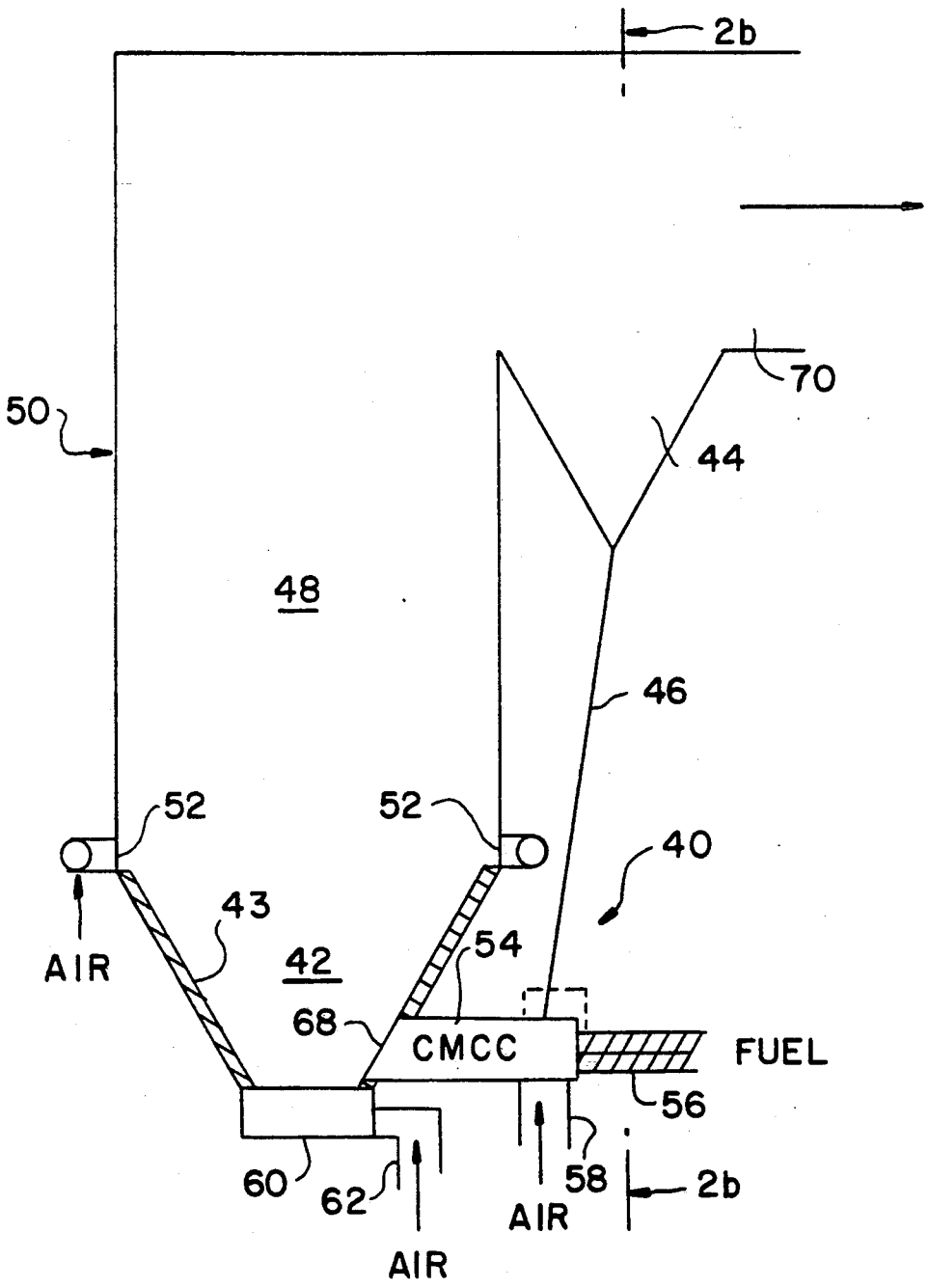
FIG. 2*a* is a view similar to FIG. 1 of a circulating fluidized bed boiler in accordance with the present invention.
Figure 2B:
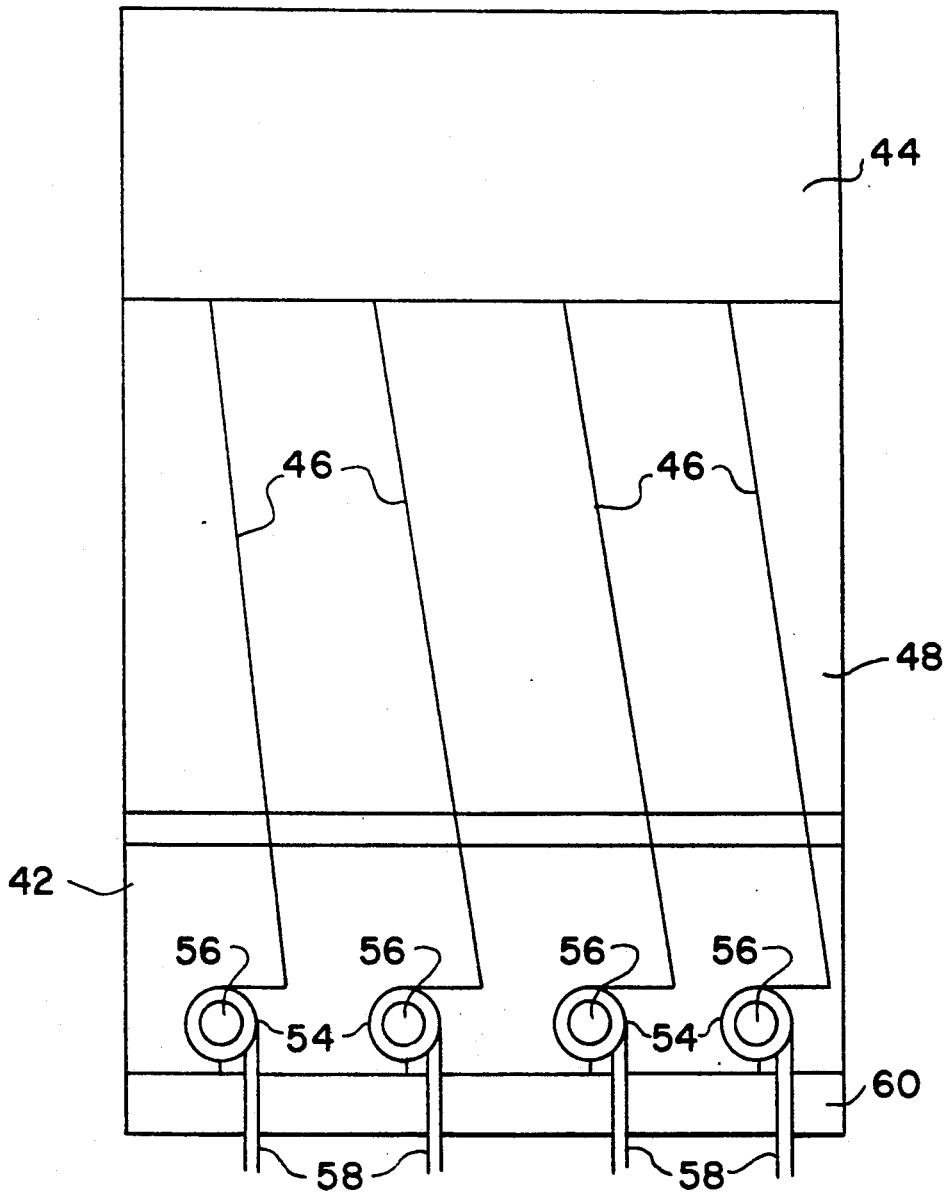
FIG. 2*b* is a schematic sectional view taken along the line 2*b*—2*b* in FIG. 2*a;*

Referring to the drawings in particular, the invention embodied in FIGS. 2*a* and 2*b* comprises an apparatus generally designated 40 for supplying fluidized bed material to a circulating fluidized bed (CFB) boiler generally designated 50.

In accordance with the invention, CFB boiler 50 includes a primary zone 42 which has a refractory lining 43. A windbox 60 at the bottom of primary zone 42 supplies a portion of the combustion air needed for burning fuel in the boiler.

A secondary or furnace zone 48 is positioned above the primary zone 42. Primary and secondary zones 42, 48 are separated by a plurality of combustion air wall ports 52 for supplying an additional portion of combustion air.

The boiler also includes a particle separator 44 and a convection pass 70. Particles which escape from the primary and secondary zones are returned by separator 44 through a return line 46 to a cyclonic mixing and combustion chamber (CMCC) 54. As shown in FIG. 2*b*, a plurality of return lines 46 which are connected to a plurality of cyclonic mixing and combustion chambers (CMCC's) 54, service one boiler.

Each of the mixing chambers 54 has a first inlet which is connected to a screw conveyor 56 for solid fuel. Each mixing chamber also includes a second inlet connected to the return line 46 for receiving the CFB solid material return by separator 44. Each mixing chamber also includes second combustion air supply means in the form of a combustion air duct 58.

Figure 3A:
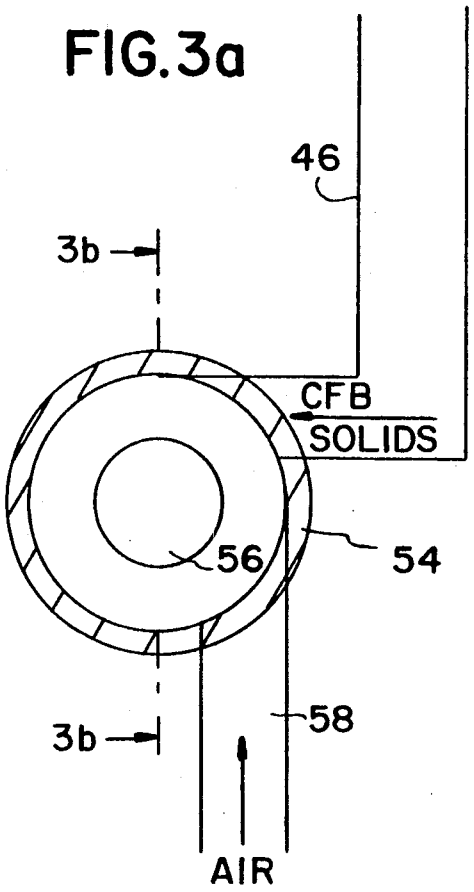
FIG. 3*a* is a sectional view taken transversely of the longitudinal axis through the cyclonic mixing and combustion chamber (CMCC) of the present invention.
Figure 3B:
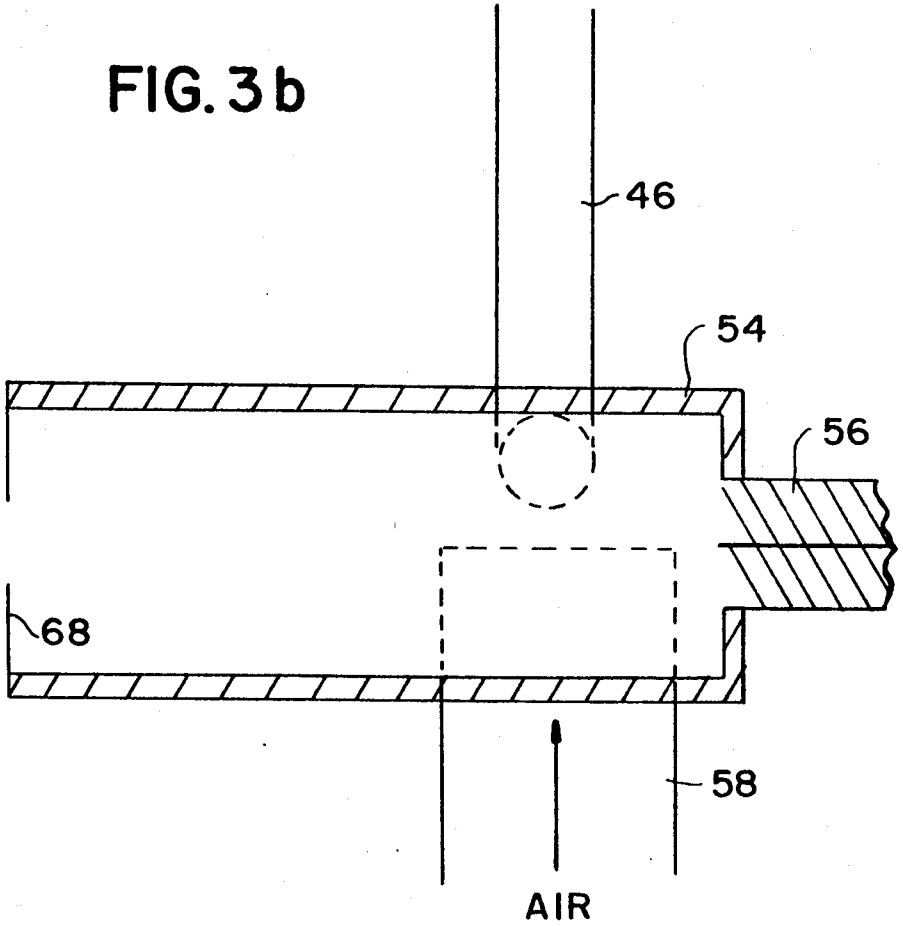
FIG. 3*b* is a sectional view taken along line 3*b*—3*b* of FIG. 3*a;*

As best shown in FIGS. 3*a* and 3*b*, each cyclonic mixing and combustion chamber (CMCC) 54 is in the form of a horizontally extending cylinder. The return line 46 for the CFB solids, and the combustion air line 58, both connect tangentially to chamber 54 at a location near the inlet of screw conveyor 56 into chamber 54. This enhances swirling and mixing of the solids and the gas components with each other as they move along the cylindrical chamber 54 and are discharged at a fuel feed point 68 into the primary zone 42.

Figure 4A:
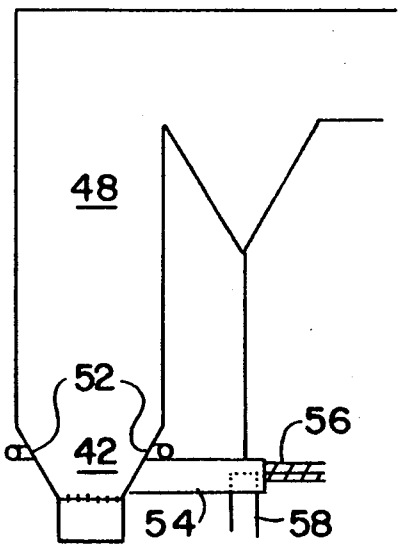
FIG. 4*a* is a view similar to FIG. 2*a*, on a reduced and simplified scale, showing an alternate embodiment of the invention.
Figure 4B:
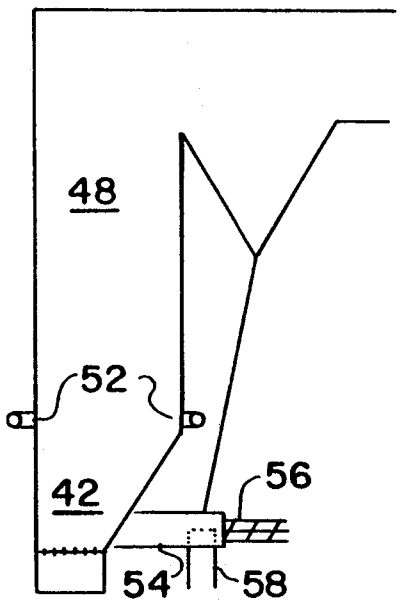
FIG. 4*b* is a view similar to FIG. 4*a* of a further embodiment of the present invention.
Figure 4C:
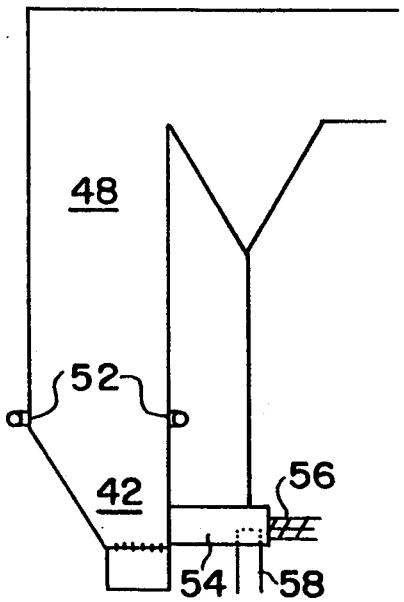
FIG. 4*c* is a view similar to FIG. 4*a* of a still further embodiment of the present invention.

As shown in FIG. 2*a*, the primary zone 42 has an upwardly increasing cross sectional area by virtue of the inclined, refractory lined walls. To avoid having a primary zone which is overly tall, the embodiment of FIG. 4*a* shows an alternate version of the invention wherein the combustion air wall ports 52, which separate the primary zone 42 from the secondary zone 48, are positioned on the inclined walls of the primary zone. FIG. 4*b* shows another version of the invention wherein only one side wall of the primary zone is inclined. In FIG. 4*c* another version of the invention shows the incline of the opposite wall of the primary combustion zone.

It is noted that throughout the drawings, the same reference numerals are utilized to designate the same on functionally similar parts.

In operation, approximately 25 to 45% of the total combustion air is supplied through the combustion air conduits 58 into the CMCC 54. From approximately 60 to 80% of the total combustion air is supplied in a combined fashion through the conduits 58 and a conduit 62 for supplying combustion air to the windbox 60. The remaining combustion air is supplied through the combustion air wall ports 52. For low loads, 100% of the combustion air can be supplied through the windbox and CMCC 54, leaving the combustion air wall ports 52 dormant.

Figure 5A:
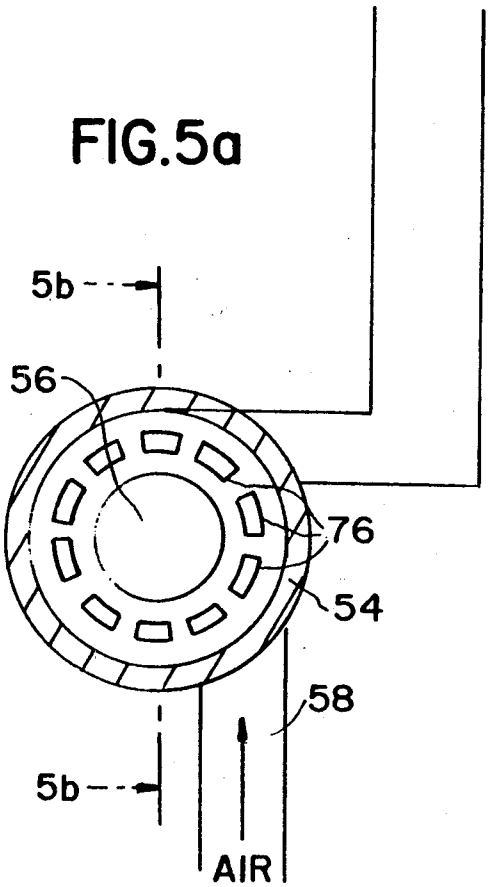
FIG. 5*a* is a view similar to FIG. 3*a* of another embodiment of the invention.
Figure 5B:
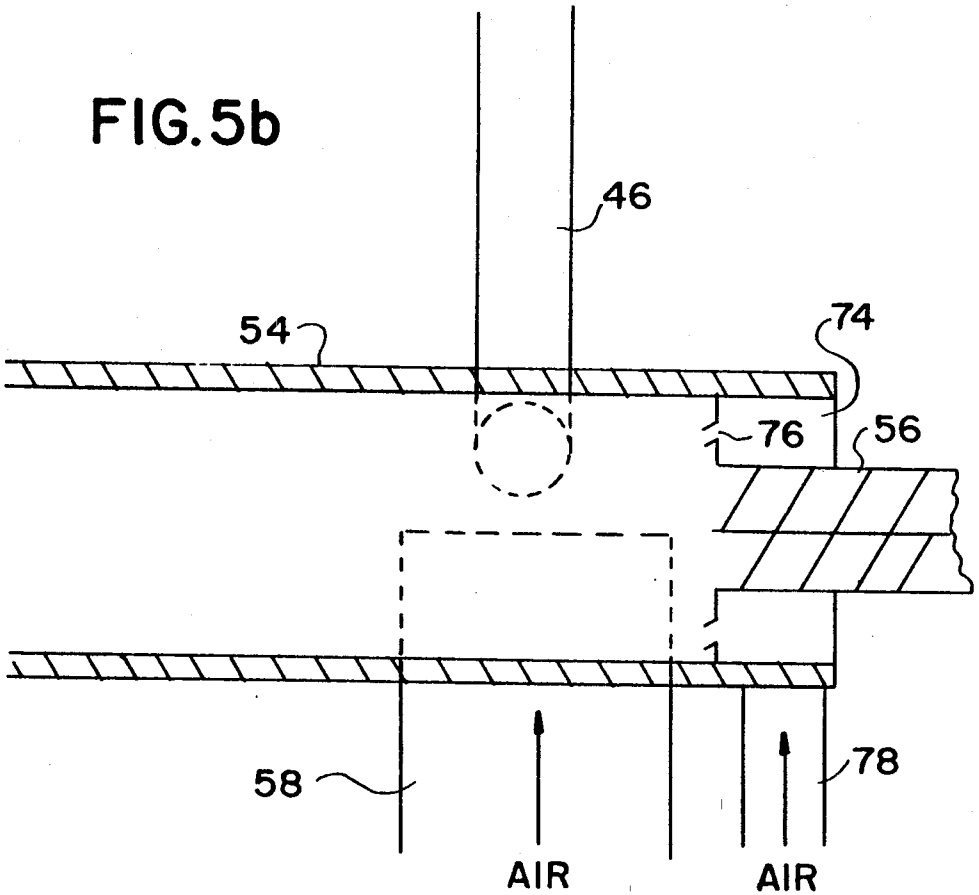
FIG. 5*b* is a sectional view taken along line 5*b*—5*b* of FIG. 5*a*.

FIGS. 5*a* and 5*b* show a still further embodiment of the invention wherein the mixing chamber 54 receives combustion air not only along conduit 58, but also through a conduit 78 which is connected to an annular chamber 74 around the outlet end of screw conveyor 56. An annular port or circular row of bores 76 communicate with the annular chamber 74 and discharge a ring of combustion air into the mixing chamber 54. This can initiate combustion prior to the main CMCC 54 combustion air input.

The operating temperature of the CMCC is controlled by varying the amount of combustion air fed to the mixing chamber to obtain the desired adiabatic equilibrium combustion temperature. Therefore, the outlet temperature of the CMCC may be higher than the temperature of the CFB solids.

The CFB solids may be fed directly into the primary zone instead of into the CMCC 54. The mixing of the combustible gas and combustion air with the solids of the primary zone would not be quite as good, however. Also, dispersion of the combustion air and combustion gases may not be as good because the CFB solids inhibit gas diffusion. If the CFB solids are already mixed with the gases, then the solids and gases diffuse together. If they are not mixed they inhibit each other's diffusion.

The solid fuel may be fed into the CMCC 54 by means other than a screw conveyor. Pneumatic transport or gravity feed through the top of the CMCC 54 may be used.

Sorbent feed, used to control the sulfur emissions, may be fed with the fuel into the CMCC 54 or fed into the primary zone or furnace zone directly.

While specific embodiments of the invention have been shown and described in detail to illustrate the application of the principles of the invention, it will be understood that the invention may be embodied otherwise without departing from such principles.

The embodiments of the invention in which an exclusive property or privilege is claimed are defined as follows:

1. An apparatus for supplying fluidized bed material to a circulating fluidized bed boiler having a primary zone with a fuel feed point for the fluidized bed material, and a furnace zone above the primary zone, the apparatus comprising:

a mixing chamber in the form of a horizontally extending cylinder having a first inlet for receiving solid fuel at an axial end of the mixing chamber opposite from the fuel feed point, a second inlet for receiving fluidized bed solids connected for tangential feed into the mixing chamber at a location near the first inlet and spaced away from the fuel feed point, and an outlet connected to the fuel feed point;

fuel feed means connected to the mixing chamber first inlet for feeding solid fuel to the mixing chamber;

first combustion air supply means connected to the primary zone of the boiler for supplying a portion of the total combustion air needed for combustion to the primary zone;

second combustion air supply means connected for tangential feed into the mixing chamber for supplying another portion of the total combustion air needed for combustion, directly to the mixing chamber for facilitating mixing between the combustion air, the fluidized bed solids and the solid fuel, in the mixing chamber, which mixture is supplied through the mixing chamber outlet and to the primary zone of the boiler; and supplemental combustion air supply means connected to the mixing chamber for supplying additional combustion air around the fuel feed means into the chamber to initiate combustion in the mixing chamber.

2. An apparatus according to claim 1 wherein said mixing chamber includes a refractory lining.

3. An apparatus according to claim 1 wherein said second combustion air supply means comprises a conduit feeding tangentially into the mixing chamber.

4. An apparatus according to claim 1 wherein the primary zone has an upwardly increasing cross sectional area from the first combustion air supply means toward the furnace zone.

5. An apparatus according to claim 1 wherein the primary zone includes at least one wall which is inclined.

6. An apparatus according to claim 1 further including third combustion air supply means connected between the primary zone and the furnace zone for supplying additional combustion air into the boiler.

7. An apparatus according to claim 6 wherein the third combustion air supply means comprises a plurality of combustion air wall ports with at least one of the wall ports positioned in the inclined wall.

8. In a circulating fluidized bed boiler having a primary zone with a fuel feed point and a furnace zone above the primary zone, an apparatus for feeding solid fuel and returning solid particles into the primary zone, comprising:

a cyclonic mixing and combustion chamber connected at an outlet to the fuel feed point in the form of a horizontally extending cylinder having a first inlet for receiving solid fuel at an axial end of the mixing chamber opposite from the fuel feed point, and a second inlet for receiving fluidized bed solids connected for tangential feed into the mixing chamber at a location near the first inlet and spaced away from the fuel feed point;

fuel feed means connected to the first inlet of the mixing chamber at an end opposite from the fuel feed point for supplying solid fuel to the chamber;

combustion air supply means, connected to feed tangentially into the chamber near the fuel feed means, for supplying a swirling flow of combustion air into the chamber to mix the combustion air with the solid fuel in the chamber before it is supplied to the fuel feed point;

a particle separator connected to the boiler above the furnace zone, and a return line connected between the particle separator and the second inlet to the chamber, for returning solid particles to the chamber for mixture with the combustion air and solid fuel therein;

supplemental combustion air supply means connected to a circular row of bores around the fuel feed means for supplying a ring of additional combustion air around the fuel feed means into the mixing chamber to initiate combustion therein; and wherein the primary zone has an upwardly increasing cross sectional area for increasing dispersion of the mixture of combustion air and solid fuel as it rises from the fuel feed point in the primary zone.

* * * * *